US008188863B2

(12) United States Patent
Rinkes et al.

(10) Patent No.: US 8,188,863 B2
(45) Date of Patent: May 29, 2012

(54) DETECTING LOADING AND UNLOADING OF MATERIAL

(75) Inventors: Charles Rinkes, Medina, OH (US); Raymond Durham, Summers, AR (US); Loren Lawrence, Rogers, AR (US); Guy Roberts, Potomac, MD (US)

(73) Assignee: Symbol Technologies, Inc., Holtsville, NY (US)

( * ) Notice: Subject to any disclaimer, the term of this patent is extended or adjusted under 35 U.S.C. 154(b) by 655 days.

(21) Appl. No.: 12/323,656

(22) Filed: Nov. 26, 2008

(65) Prior Publication Data

US 2010/0127870 A1 May 27, 2010

(51) Int. Cl.
*G08B 13/14* (2006.01)

(52) U.S. Cl. ..... 340/572.1; 340/539.13; 340/5.92; 340/10.03; 340/539.23

(58) Field of Classification Search ..... 340/572.1, 340/539.13, 5.92, 10.3, 539.23, 539.22; 705/14.24, 705/22, 28; 235/385; 700/236
See application file for complete search history.

(56) References Cited

U.S. PATENT DOCUMENTS

| | | | | |
|---|---|---|---|---|
| 5,559,318 | A | 9/1996 | Aoki | |
| 5,621,202 | A | 4/1997 | Aoki | |
| 6,611,757 | B2 | 8/2003 | Brodie | |
| 7,026,935 | B2 | 4/2006 | Diorio et al. | |
| 7,030,761 | B2 | 4/2006 | Bridgelall et al. | |
| 7,073,712 | B2 | 7/2006 | Jusas | |
| 7,180,403 | B2 | 2/2007 | Quan | |
| 7,180,420 | B2 | 2/2007 | Maurer | |
| 7,271,702 | B2 | 9/2007 | Patil et al. | |
| 7,295,114 | B1 | 11/2007 | Drzaic et al. | |
| 7,317,378 | B2 | 1/2008 | Jarvis et al. | |
| 7,348,886 | B2 | 3/2008 | Himberger et al. | |
| 7,378,967 | B2 | 5/2008 | Sullivan et al. | |
| 7,388,491 | B2 | 6/2008 | Chand et al. | |
| 7,394,358 | B2 | 7/2008 | Cherry | |
| 7,492,254 | B2 | 2/2009 | Bandy et al. | |
| 7,492,256 | B2 | 2/2009 | Eren et al. | |
| 7,580,724 | B2 | 8/2009 | Ueda | |
| 7,623,036 | B2 | 11/2009 | Onderko et al. | |
| 7,652,577 | B1 | 1/2010 | Madhow et al. | |
| 7,786,936 | B2 | 8/2010 | Kurokawa | |
| 7,812,727 | B2 * | 10/2010 | Takahashi et al. | 340/572.1 |
| 7,822,424 | B2 * | 10/2010 | Markhovsky et al. | 455/456.1 |
| 7,852,198 | B2 | 12/2010 | Montgomery et al. | |
| 7,911,324 | B2 | 3/2011 | Breed et al. | |
| 2002/0149480 | A1 | 10/2002 | Shanks et al. | |
| 2005/0020279 | A1 * | 1/2005 | Markhovsky et al. | 455/456.1 |
| 2005/0068194 | A1 | 3/2005 | Schleich et al. | |
| 2005/0099309 | A1 | 5/2005 | Hum et al. | |
| 2005/0174239 | A1 | 8/2005 | Shanks et al. | |
| 2005/0206555 | A1 | 9/2005 | Bridgelall et al. | |

(Continued)

OTHER PUBLICATIONS

PCT International Search Report Dated Aug. 5, 2009 for Related U.S. Appl. No. 12/137,370.

(Continued)

*Primary Examiner* — Hoi Lau
(74) *Attorney, Agent, or Firm* — Bartholomew DiVita; Terri Hughes Smith; Kenneth A. Haas

(57) ABSTRACT

An apparatus and techniques for detecting the loading and unloading of materials on a mobile structure are disclosed. The techniques can be used to detect when material is on a support structure of the mobile structure and to detect when the material is off the support structure of the mobile structure.

25 Claims, 6 Drawing Sheets

U.S. PATENT DOCUMENTS

2005/0264416 A1 12/2005 Maurer
2005/0280508 A1 12/2005 Mravca et al.
2006/0012476 A1* 1/2006 Markhovsky et al. ... 340/539.32
2006/0022800 A1 2/2006 Krishna
2006/0022814 A1* 2/2006 Nogami et al. ..... 340/505
2006/0176152 A1 8/2006 Wagner et al.
2006/0197652 A1* 9/2006 Hild et al. ..... 340/10.2
2006/0238303 A1 10/2006 Loving et al.
2006/0238304 A1 10/2006 Loving et al.
2006/0238305 A1 10/2006 Loving et al.
2006/0287759 A1* 12/2006 Charych ..... 700/213
2007/0018792 A1 1/2007 Taki et al.
2007/0096876 A1 5/2007 Bridgelall et al.
2007/0174907 A1 7/2007 Davis
2007/0205868 A1 9/2007 Tanaka
2007/0252676 A1* 11/2007 Madej et al. ..... 340/10.3
2007/0252702 A1 11/2007 Wulff et al.
2008/0042803 A1 2/2008 Posamentier
2008/0042828 A1* 2/2008 Christopher ..... 340/539.13
2008/0042829 A1* 2/2008 Christopher ..... 340/539.13
2008/0061937 A1* 3/2008 Park ..... 340/10.1
2008/0106416 A1 5/2008 Sullivan et al.
2008/0191845 A1 8/2008 Strzelczyk
2008/0231449 A1 9/2008 Moshfeghi
2009/0036060 A1* 2/2009 Takahashi et al. ..... 455/67.14
2009/0101447 A1* 4/2009 Durham et al. ..... 187/238
2009/0146784 A1 6/2009 Soleimani et al.
2009/0207024 A1* 8/2009 Schatz et al. ..... 340/572.1
2009/0210940 A1 8/2009 Dean
2010/0127870 A1* 5/2010 Rinkes et al. ..... 340/572.1
2011/0137491 A1* 6/2011 Self et al. ..... 701/2

OTHER PUBLICATIONS

PCT International Preliminary Report on Patentability for Related U.S. Appl. No. 12/137,370, dated Dec. 13, 2010.
Office Action mailed Oct. 31, 2011, in related U.S. Appl. No. 12/029,452, Martin Strzelczyk, filed Feb. 11, 2008.
Office Action mailed Apr. 29, 2011, in related U.S. Appl. No. 12/029,452, Martin Strzelczyk, filed Feb. 11, 2008.
Office Action mailed Mar. 3, 2011, in related U.S. Appl. No. 12/029,450, Martin Strzelczyk, filed Feb. 11, 2008.
Office Action mailed Jun. 24, 2011, in related U.S. Appl. No. 12/137,370 Tong-Hsiao, filed Jun. 11, 2008.

* cited by examiner

DETECTING LOADING AND UNLOADING OF MATERIAL

TECHNICAL FIELD

This disclosure relates to radio frequency identification (RFID) technology, and more particularly to detecting loading and unloading of material from a mobile structure using RFID technology.

BACKGROUND

When tracking the movement of RFID tagged materials, such as inventory, using RFID enabled mobile structures, such as a fork lift, it is desirable to know when the materials have been loaded onto the mobile structure and when the materials have been unloaded from the structure. Determining such knowledge can allow an RFID reader to be activated or deactivated at an appropriate time.

To achieve this knowledge, some embodiments use manual intervention to activate or deactivate the RFID reader once the materials are loaded or unloaded from the mobile structure. Manual intervention, however, tends to slow the pace of mobile structure operators and is prone to human error. Other embodiments use automated techniques that utilize sensors to determine when materials are loaded on or unloaded from mobile structures. These techniques, however, do not account for the numerous unique situations that can occur in a warehouse environment, such as when workers walk in front of the sensors, the swaying and rocking of material as it is transported, and the inherent noise and false readings present in most distance measuring devices.

Accordingly, there is a need for an improved approach to determining whether a material is positioned on or off a mobile structure.

SUMMARY

An apparatus and techniques for detecting the loading and unloading of materials on a mobile structure are disclosed. The techniques can be used to detect when material is on a support structure of the mobile structure and to detect when the material is off the support structure of the mobile structure.

For example, according to one aspect, a method for determining whether an object is positioned on or off a support structure of a mobile structure includes comparing a current distance value to a prior distance value and a N number of pre-programmed distance measurements. The prior distance value is a distance measurement from the mobile structure to the object at a first time period and the current distance value is a distant measurement from the mobile structure to the object at a second time period. The second time period is subsequent to the first time period and N is an integer value greater than 1.

The method includes setting a value of a direction variable to represent a movement of the mobile structure in a forward or reverse direction based on the comparison of the current distance value to the prior distance value, and setting a plurality of trip point values to represent movement of the mobile structure over the N number of pre-programmed distance measurements based on the comparison of the current distance value with the N number of pre-programmed distance measurements.

The method also includes determining an on-off condition for the object based on the direction variable and the plurality of trip point values set.

In one embodiment, the method includes comparing the current distance value to a first noise threshold value, the first noise threshold value being a distance measurement, and determining the on-off condition based on the direction variable, the plurality of set trip points, and the comparison of the current distance value to the noise threshold value. The method can also include incrementing a value of a noise counter variable if the current distance value exceeds a first noise threshold value.

In another embodiment, the method includes comparing the value of the noise counter variable to a second noise threshold value, the second noise threshold value being a numeric integer value, and setting the plurality of trip point values and the direction variable to indicate non-movement of the mobile structure based on the comparison. Preferably, the method includes setting the on-off condition to an OFF value if the value of the direction variable represents the reverse direction and the plurality of trip point values indicate the movement of the mobile structure. The OFF value represents the object positioned off the support structure.

The method can also include incrementing a value of a reverse counter variable if the current distance value exceeds the prior distance value, comparing the value of the reverse counter variable to a reverse threshold value, the reverse threshold value being a numeric count value, and setting the direction variable to indicate the REVERSE direction of the mobile structure based on the comparison. In one embodiment, the method also includes comparing the current distance value to the prior distance value if the current distance value exceeds a length of the support structure.

In yet another embodiment, the method includes setting the on-off condition to an ON value if the value of the direction variable represents the forward direction and the plurality of trip point values indicate the movement of the mobile structure, the ON value representing the object positioned on the support structure. The method can include incrementing a value of a forward counter variable if the current distance value is less than the prior distance value, comparing the value of the forward counter variable to a forward threshold value, the forward threshold value being a numeric count value, and setting the direction variable to indicate the FORWARD direction of the mobile structure based on the comparison. The method can include comparing the current distance value to the prior distance value if the current distance value is less than a length of the support structure.

The method can include operatively coupling a proximity sensor to the mobile structure to determine the current distance and prior distance values.

The method can also include at least one of activating and deactivating the RFID reader to communicate with the RFID tag based on the on-off condition.

In another aspect, an RFID reader is operatively coupled to a mobile structure. The RFID reader is configured to determine whether an object associated with an RFID tag is positioned on or off a support structure of the mobile structure. The RFID reader includes a processor and a memory configured to include memory storing instructions that, in response to a request, cause the processor to compare a current distance value to a prior distance value and a N number of pre-programmed distance measurements. The prior distance value is a distance measurement from the mobile structure to the object at a first time period and the current distance value is a distant measurement from the mobile structure to the object at a second time period, the second time period subsequent to the first time period, N being an integer value greater than 1.

The RFID reader sets a value of a direction variable to represent a movement of the mobile structure in a forward or reverse direction based on the comparison of the current distance value to the prior distance value and sets a plurality of trip point values to represent movement of the mobile structure over the N number of pre-programmed distance measurements based on the comparison of the current distance value with the N number of pre-programmed distance measurements.

The RFID reader then determines an on-off condition for the object based on the direction variable and the plurality of trip point values set.

In one embodiment, the RFID reader compares the current distance value to a first noise threshold value, the first noise threshold value being a distance measurement, and determines the on-off condition based on the direction variable, the plurality of set trip points, and the comparison of the current distance value to the noise threshold value.

In one embodiment, the RFID reader increments a value of a noise counter variable if the current distance value exceeds the first noise threshold value. The RFID reader then compares the value of the noise counter variable to a second noise threshold value, the second noise threshold value being a numeric integer value. Based on the comparison, the RFID reader can set the plurality of trip point values and the direction variable to indicate non-movement of the mobile structure.

Various advantages can be obtained using the present invention. For example, workers walking in front of the mobile structure do not cause false detection of material on the mobile structure. In addition, the present invention can eliminate false detection of empty conditions due to rocking of material during transport. Another advantage of the present invention relates to the elimination of false detection of material being on or off the mobile structure due to the surface composition of the material loaded on the mobile structure.

The present invention can also be used to eliminate false detection of material being on or off the mobile structure due to the inherent noise or false readings produced by distance measuring devices. Furthermore, false detection of material being on or off the mobile structure due to the mobile structure partially pulling into or backing out of a pallet can be eliminated.

Additional features and advantages will be readily apparent from the following detailed description, the accompanying drawings and claims.

BRIEF DESCRIPTION OF DRAWINGS

Like reference symbols in the various drawings indicate like elements.

DETAILED DESCRIPTION

Embodiments are described herein for determining whether an object is positioned on or off a mobile structure. These embodiments can be implemented anywhere that RFID readers and tags are used. For example, embodiments can be implemented in a commercial or industrial environment, such as in a warehouse, a factory, a business, or store, and in a military or other non-commercial environment. Although the mobile structure discussed below is described in terms of a forklift (for illustrative purposes), embodiments of the present invention are applicable to further types of mobile structures, including warehouse box crushers, conveyors, cars, trucks, etc.

Figure 1:
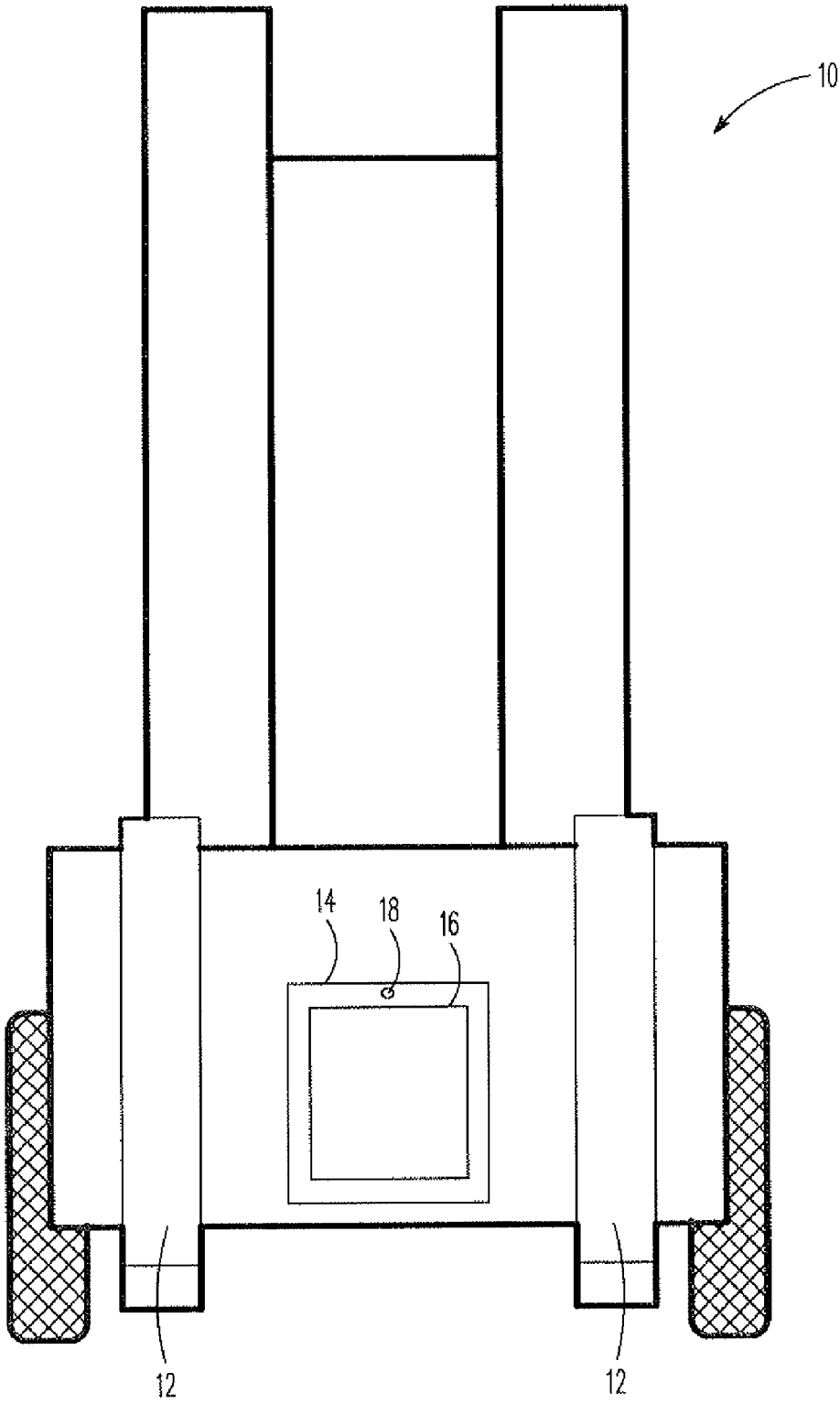
FIGS. 1-3 show views of a mobile structure with an RFID reader.

Referring now to FIG. 1, a mobile structure including a data capture device having an RFID reader with a proximity detecting device for detecting the loading and unloading of an object is disclosed. The data capture device is capable of being mounted in close proximity to an object being transferred. This includes being mounted at, or between a support structure of the mobile structure. For example, as shown in FIG. 1, a data capture device 14 having an integrated RFID reader 16 and a proximity detection device 18 is disposed between forks 12 of a forklift 10 (e.g., in the "load back rest" area). The data capture device 14 could alternatively be mounted on pallets jacks, hand trucks, conveyor belts, and any other type of industrial freight moving equipment.

Figure 2:
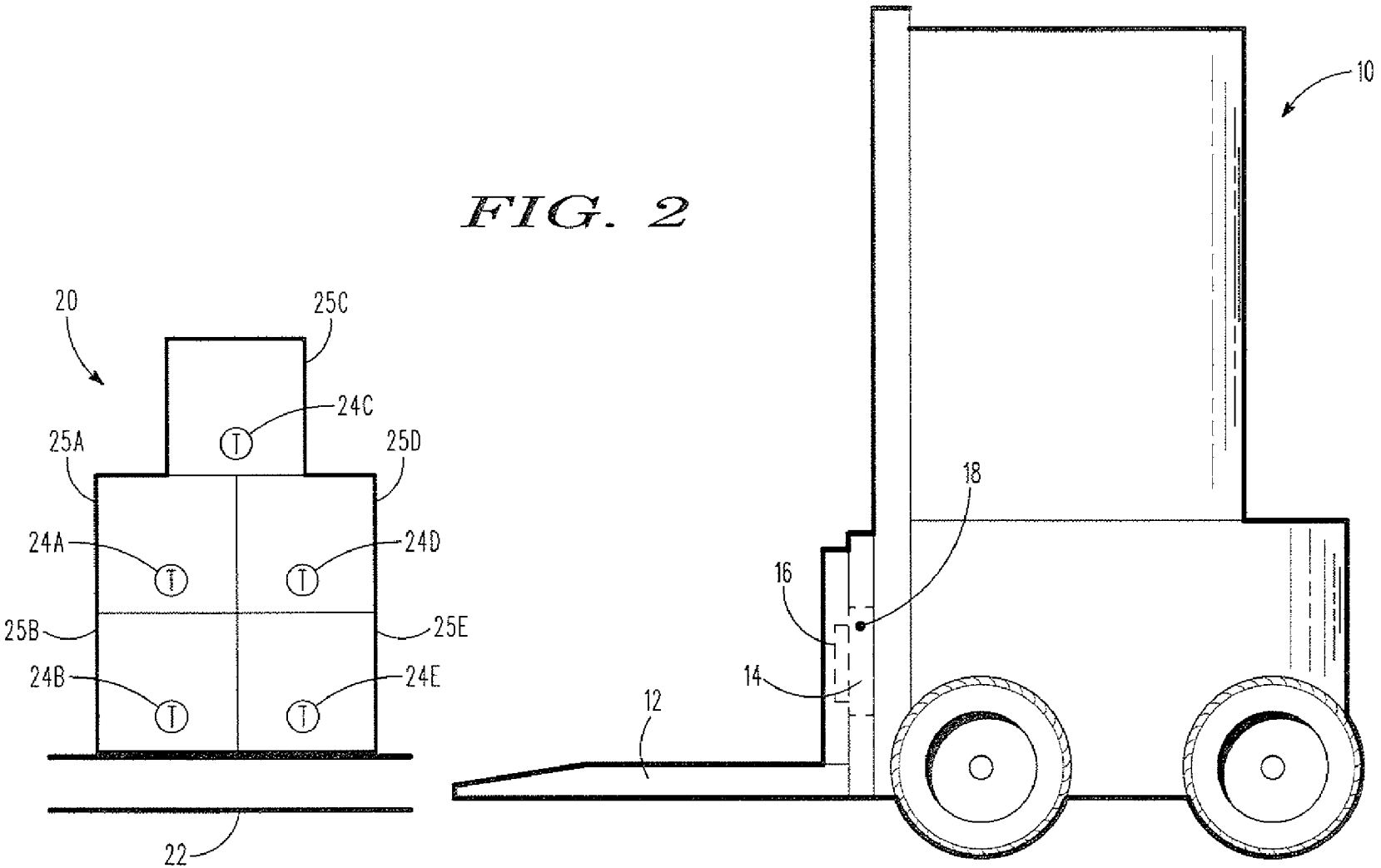

FIG. 2 shows a side view of the forklift 10, with forks 12 of the forklift 10 at a near bottom position. The forks 12 of the forklift 10 provide a support structure in which a load 20 comprising one or more objects 25A-E can be positioned on and off. As defined herein, an OFF condition exists as the load 20 e.g., cargo, is completely off of the support structure 12 of the forklift 10 and the forklift 10 is free to move about without disrupting that material. As shown in FIG. 2, the load 20 can be positioned on a pallet 22.

Figure 3:
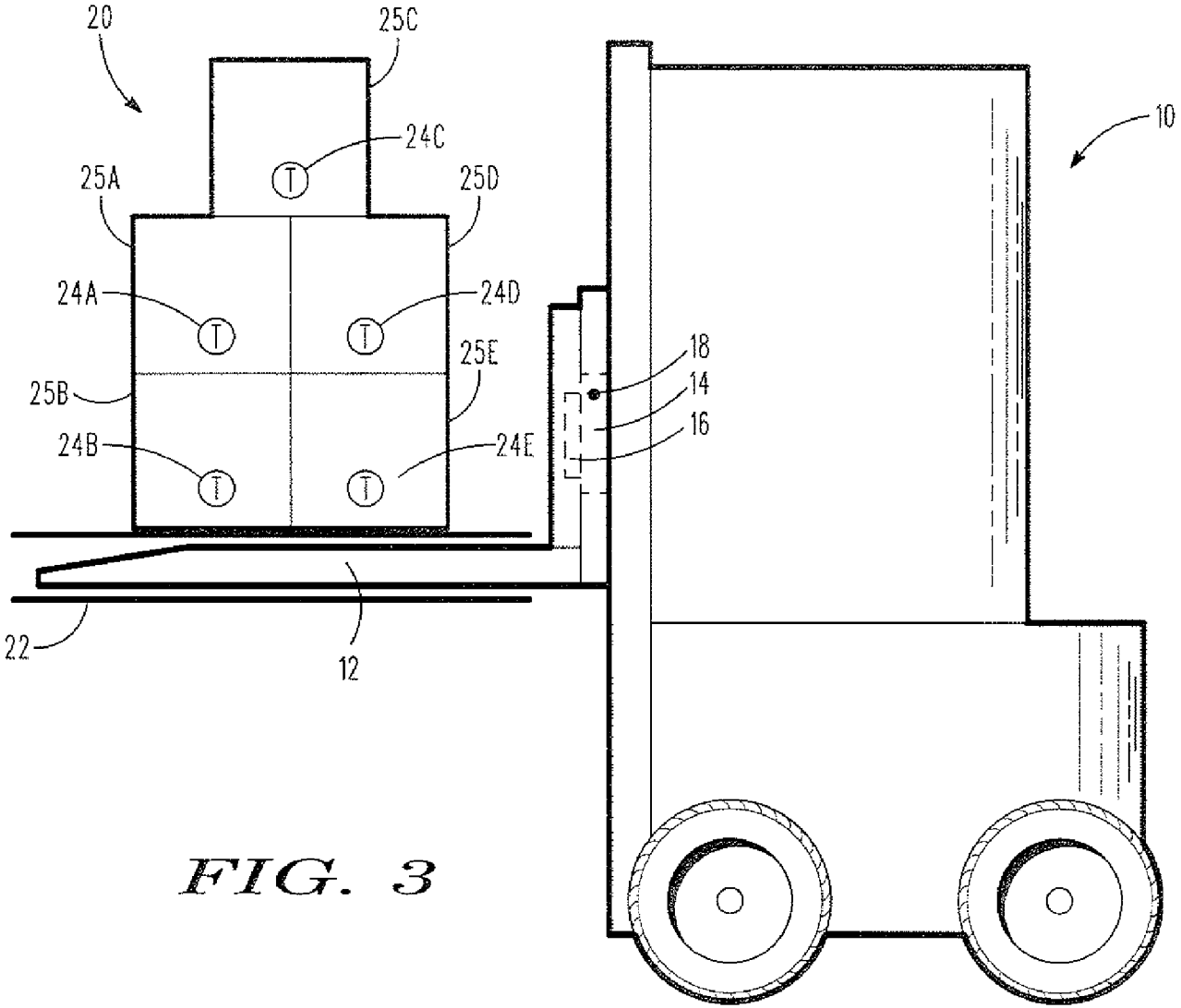

FIG. 3 shows a side view of the forklift 10, with forks 12 raised to a middle position and supporting the load 20 of objects 25A-E for transportation. As defined herein, an ON condition exists when the load 20 is positioned on the support structure 12 of the forklift 10 and is able to be safely transported. As shown in FIGS. 2 and 3, each of the objects 25A-E has a respective RFID tag 24A-E attached thereto.

The data capture device 14 can have internal logic that activates the integrated RFID reader 16 to communicate with REID tags 24A-E once an ON condition is determined. Likewise, the data capture device 14 can have internal logic that deactivates the integrated RFID reader upon detection of an OFF condition. Such features are described more fully below.

To capture data associated with the RFID tags 24A-E, the data capture device 14, via the integrated RFID reader 16, transmits an interrogation signal having a carrier frequency to the population of tags 24A-E. The integrated RFID reader 16 can operate in one or more of the frequency bands allotted for this type of RF communication. For example, frequency bands of 902-928 MHz and 2400-2483.5 MHz have been defined for certain RFID applications by the Federal Communication Commission (FCC).

Various types of RFID tags may be present in tag population 24A-E that transmit one or more response signals to the interrogating RFID reader 16. For example, the RFID tags 24 may alternately reflect and absorb portions of the signal according to a time-based pattern or frequency. This technique for alternatively absorbing and reflecting signal is referred to herein as backscatter modulation. Other technologies are known in the art. The integrated RFID reader 16 receives and obtains data from response signals via an RFID antenna assembly (Shown in FIG. 4), such as an identification number of the responding tag 24. In the embodiments described herein. The data capture device 14 with the integrated RFID reader 16 may be capable of communicating with tags 24A-E according to any suitable communication protocol, including binary traversal protocols, slotted aloha protocols, Class 0, Class 1, EPC Gen 2, any others mentioned elsewhere herein, and future communication protocols.

In one embodiment, the data capture device 14 is configured to include a proximity sensor 18 to measure distance from the mobile structure 10 to an object. The data capture device 14 can activate the RFID reader 16 when an object is positioned in its path at a predetermined minimum range. For example, the RFID reader 16 can be deactivated until an object is loaded onto the mobile structure, at which occurrence the reader 16 would be activated. After the reader 16 is activated to read the appropriate tags, the reader 16 could be deactivated until the pallet 22 or load 20 is off-loaded. The proximity sensor 18 would again activate the reader 16, reading the appropriate tags again, confirming that the load 20 was dropped off. The proximity sensor 18 could be based on any switch technology, i.e., IR, sonic, optical, etc.

Figure 4:
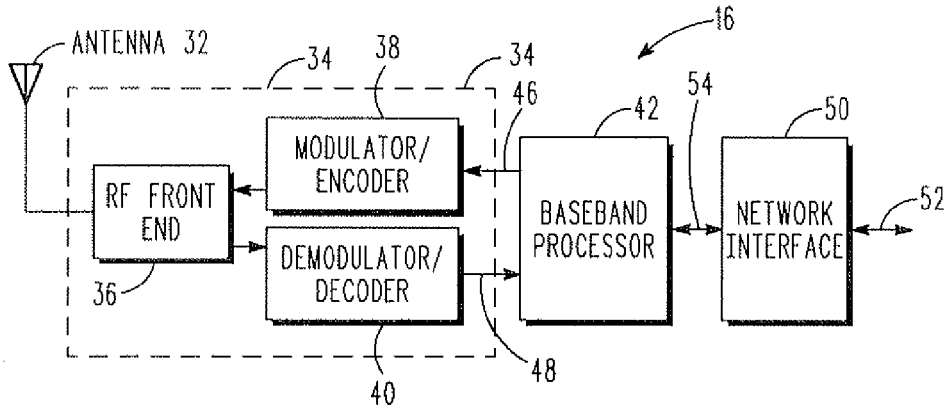
FIG. 4 shows a block diagram of an RFID reader.

FIG. 4 shows a block diagram of an example RFID reader 16. The reader 16 includes one or more antennas 32, a receiver and transmitter portion 34, a baseband processor 42, and a network interface 50. These components of reader 16 may include software, hardware, and/or firmware, or any combination thereof, for performing their functions.

Baseband processor 42 and network interface 50 are optionally present in the reader 16. Baseband processor 42 may be present in reader 16, or may be located remote from reader 16. For example, in an embodiment, network interface 50 may be present in the reader 16 to communicate between the transceiver portion 34 and a remote server that includes baseband processor 42. When the baseband processor 42 is present in the reader 16, the network interface 50 may be optionally present to communicate between the baseband processor 42 and a remote server. In another embodiment, the network interface 50 is not present in reader 16.

In one embodiment, the reader 16 includes the network interface 50 to interface the reader 16 with a communications network 52. As shown in FIG. 4, the baseband processor 42 and network interface 50 communicate with each other via a communication link 54. The network interface 50 is used to provide an interrogation request 46 to the transceiver portion 34 (optionally through baseband processor 42), which may be received from a remote server coupled to the communications network 52. The baseband processor 42 optionally processes the data of interrogation request 46 prior to being sent to the transceiver portion 34. The transceiver 34 transmits the interrogation request via the antenna 32.

As shown in FIG. 4, the reader 16 includes at least one antenna 32 for communicating with tags 24A-E and/or other readers 16. The antenna(s) 32 may be any type of reader antenna known to persons skilled in the relevant art(s), including a vertical, dipole, loop, Yagi-Uda, slot, or patch antenna type.

The transceiver portion 34 receives a tag response via the antenna 32 and outputs a decoded data signal 48 generated from the tag response. The network interface 50 is used to transmit a decoded data signal 48 received from the transceiver portion 34 (optionally through baseband processor 42) to a remote server coupled to communications network 52. The baseband processor 42 optionally can process the data of decoded data signal 48 prior to being sent over communications network 52.

In embodiments, the network interface 50 enables a wired and/or wireless connection with communications network 52. For example, the network interface 50 may enable a wireless local area network (WLAN) link (including a IEEE 802.11 WLAN standard link), a BLUETOOTH link, and/or other types of wireless communication links. The communications network 52 may be a local area network (LAN), a wide area network (WAN) (e.g., the Internet), and/or a personal area network (PAN).

In embodiments, a variety of mechanisms may be used to initiate an interrogation request by the reader 16. For example, the RFID reader 16 can be activated to send an interrogation request upon an object being detected on the mobile structure. When the object is detected off the mobile structure, the RFID reader 16 can be deactivated. In addition, in embodiment, the reader 16 can include a finger-trigger mechanism, a keyboard, a graphical user interface (GUI), and/or a voice activated mechanism with which a user of reader 16 may interact to activate and deactivate the reader 16.

In the example of FIG. 4, the transceiver portion 34 includes a RF front-end 36, a demodulator/decoder 40, and a modulator/encoder 38. These components of the transceiver portion 34 may include software, hardware, and/or firmware, or any combination thereof, for performing their functions. Example description of these components is provided as follows.

As shown in FIG. 4, the modulator/encoder 38 receives interrogation request 46, and is coupled to an input of RF front-end 36. The modulator/encoder 38 encodes interrogation request 46 into a signal format, such as one of FM0 or Miller encoding formats, modulates the encoded signal, and outputs the modulated encoded interrogation signal to RF front-end 36.

The RF front-end 36 may include one or more antenna matching elements, amplifiers, filters, an echo-cancellation unit, a down-converter, and/or an up-converter. The RF front-end 36 receives a tag response signal through antenna 32 and down-converts (if necessary) the response signal to a frequency range amenable to further signal processing. Furthermore, RF front-end 36 receives a modulated encoded interrogation signal from modulator/encoder 38, up-converts (if necessary) the interrogation signal, and transmits the interrogation signal to antenna 32 to be radiated.

The demodulator/decoder 40 is coupled to an output of the RF front-end 36, receiving a modulated tag response signal from RF front-end 36. The demodulator/decoder 40 demodulates the tag response signal. For example, the tag response signal may include backscattered data encoded according to FM0 or Miller encoding formats in an EPC Gen 2 embodiment. Demodulator/decoder 206 outputs decoded data signal 48.

The configuration of transceiver portion 34 shown in FIG. 4 is provided for purposes of illustration, and is not intended to be limiting. Further, transceiver portion 34 may be configured in numerous ways to modulate, transmit, receive, and demodulate RFID communication signals, as would be known to persons skilled in the relevant art(s).

Figure 5:
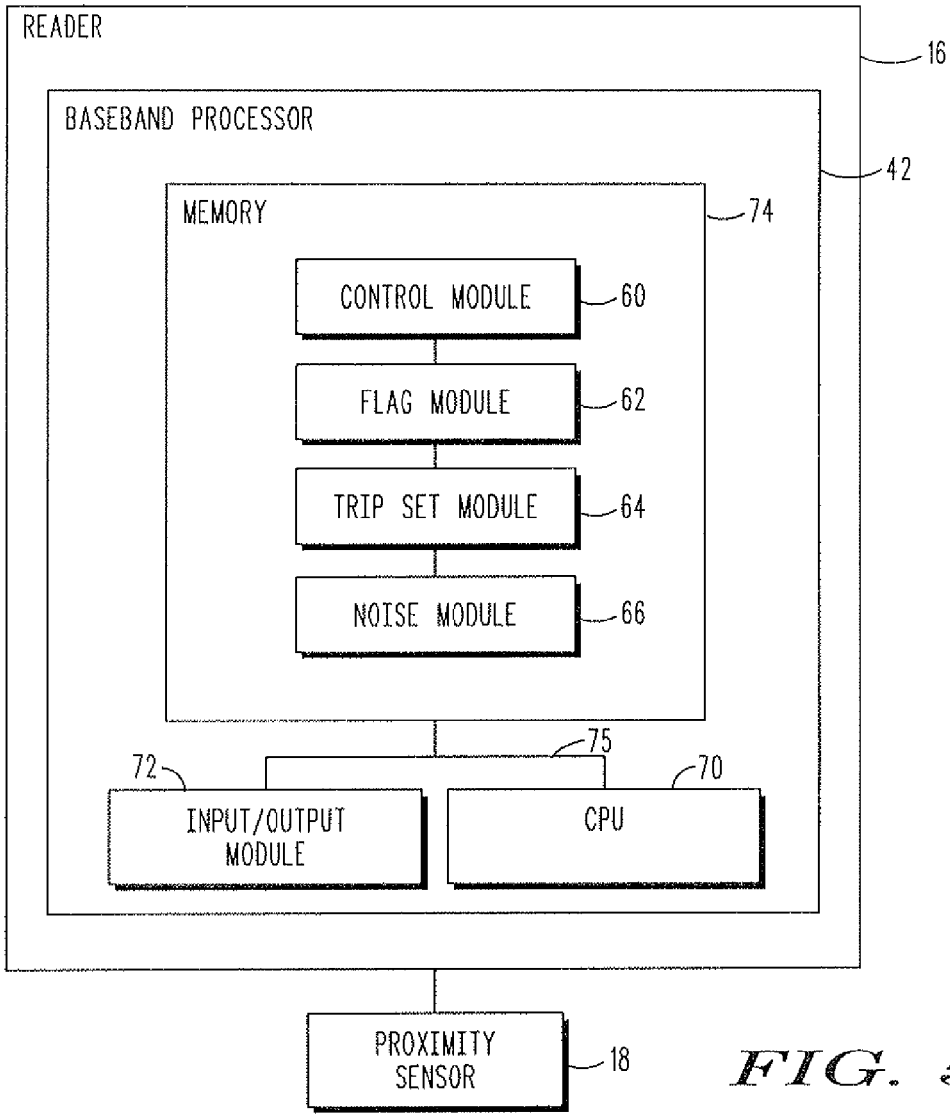
FIG. 5 shows a block diagram of a reader according to an example embodiment of the present invention.

Turning now to FIG. 5, additional details of the baseband processor 42 of the present invention are disclosed. As shown in FIG. 5, in one embodiment, the baseband processor 42 is incorporated into the reader 16 and includes a central processor unit (CPU) 70, an input-output module 72, and a memory 74, all of which are interconnected via a bus line 75 and controlled by the CPU 70. In one exemplary embodiment, the memory 74 of the processor 42 is configured to include a control module 60, a flag module 62, a trip set module 64 and a noise module 66. Details of the control module 60 and its interaction with the flag module 62, trip set module 64 and noise module 66 are discussed below.

The control module 60 executes a method to determine when material is on or off the support structure of the mobile structure. For example, in a forklift implementation, a forklift picking up and dropping off or dropping off material progresses through a sequence of steps. The control module 60 determines whether each step is completed in a correct order, so that false ON/OFF conditions are not detected due to someone walking in front of the forks, partially pulling into or backing out of a pallet, pallets rocking on the forks during transport, etc.

In order to determine whether an ON condition exists, in one embodiment, the control module 60 receives distance measurements from the proximity sensor 18. The control module 60 then determines whether the received distance from the object is greater than the length of the fork. The received distances compared must be decreasing for a programmable number of distance readings through at least two programmable distance points down to a minimum distance deemed safe for transport. Using this technique, the control module 60 can eliminate false ON condition events due to someone walking in front of or stepping over the forks, someone partially inserting the forks to slide or move material or noisy readings from the distance measuring device.

In order to determine whether an OFF condition exists, in one embodiment, the control module 60 receives distance measurements from the proximity sensor 18. The control module 60 then determines whether the received distance from the object is less than the length of the mobile structure support structure. The distance measurements must then increase for a programmable number of distance readings through at least two programmable distance points to a final distance deemed to be greater than the length of the forks on the lift. Utilizing this technique, the control module 60 can eliminate false OFF conditions due to the pallet rocking during transport or due to anomalous readings because of the type of material being transported.

The flag module 62 is used by the control module 60 to determine the direction of movement of the mobile structure. For example, in one embodiment, the control module directs the flag module 62 to set a direction variable to represent a movement of the mobile structure in a forward or reverse direction based on a comparison of the current distance value received to a prior distance value received.

The trip set module 64 is used by the control module 60 to set one or more trip point values to represent movement of the mobile structure over pre-programmed distance measurements. The trip point values are set based on a comparison of the current distance value received with each of the preprogrammed distance measurements.

The noise module 66 is used to minimize the effect of noise in the mobile structure environment that can affect a determination of whether an ON or OFF condition exists. Noise can be the result of the material being transported. For example, certain materials reflect certain types of electronic signals used to detect distance in different ways. Some materials for example can cause acoustic signals to give erroneous readings when that material is very close to the proximity sensor. Some types of distance measuring devices can also be overwhelmed at very close distances causing them to give wild readings. In order to safeguard against noise causing a false ON or OFF condition, in one embodiment, the noise module 66 determines whether received distance measurement readings indicate that the mobile structure is traveling faster than it is capable of. If enough of these distance measurements are received within a programmable time period, the noise module 66 directs the control module 60 to restart the conditions needed to detect an ON/OFF condition.

Figure 6A:
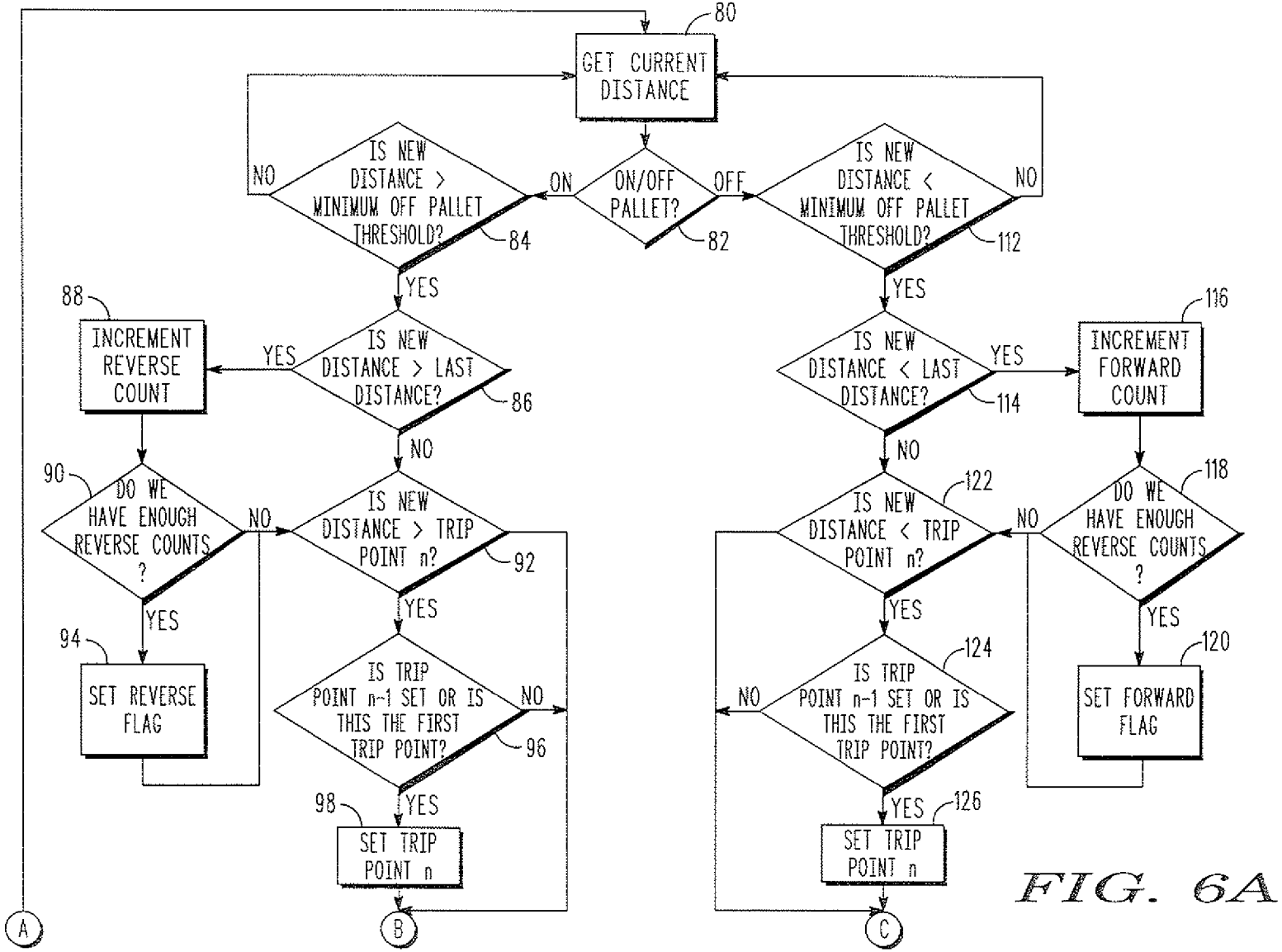
FIG. 6 shows a flowchart of steps executed to detect an on-off condition according to the present invention.
Figure 6B:
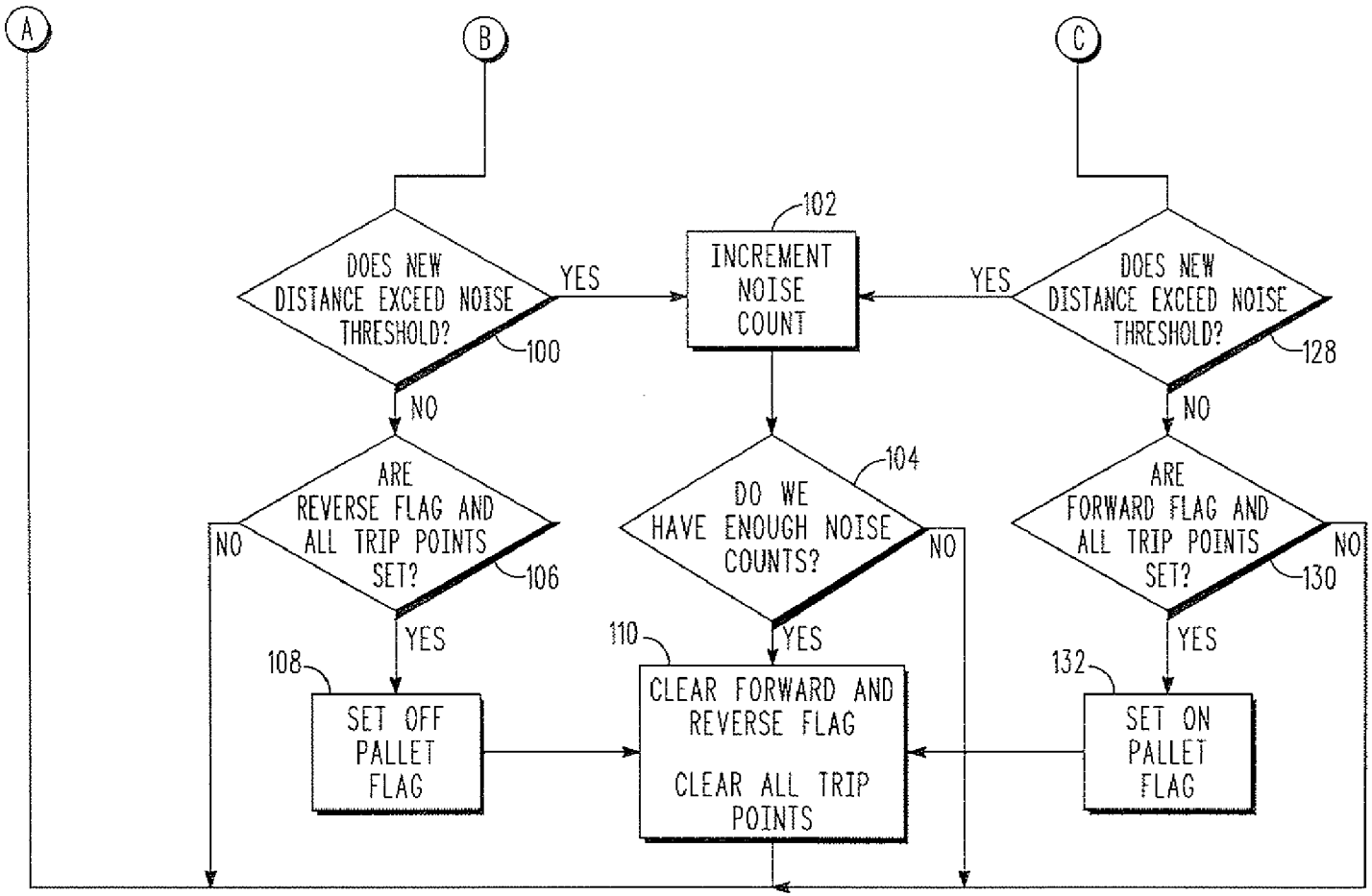

Turning now to FIG. 6, further details of an example method executed by the control module 60 detect an ON and OFF condition are disclosed. First, as shown in FIG. 6, the control module 60 receives a current distance measurement from the mobile structure to an object 80. The distance measurement can be received from a proximity sensor. Next, if an OFF condition is to be detected 82, the control module 60 determines if the current distance value exceeds the predetermined minimum distance needed to begin detection of an OFF condition 84 of the mobile structure. If the current distance measurement meets this condition, the control module 60 then compares the current distance value observed with a distance value observed at a prior time period 86. If the current distance measurement exceeds the prior distance measurement, the control module 60 increments a value of a reverse counter 88 which represents movement of the mobile structure in a reverse direction. The control module 60 then compares the value of the reverse counter variable to a reverse threshold value 90 representing a number of occasions a reverse movement has been detected, and directs the flag module 62 to set a direction variable to indicate the REVERSE direction of the mobile structure if the value of the reverse counter variable meets or exceeds the reverse threshold value.

Next, the control module 60 compares the current distance measurement to a number of preprogrammed distance measurements. If the current distance measurement exceeds the maximum preprogrammed distance measurements 92, the control module 60 determines whether a previous trip point value is set or alternatively, whether a first trip point value is to be set 96. If the previous trip point value is set or the first trip point value is to be set, the control module 60 directs the trip set module 64 to set a point value to represent movement of the mobile structure over a preprogrammed distance 98.

Next, the control module 60 determines whether the current distance value exceeds a noise threshold value 100. If 1) the current distance value does not exceed the noise threshold value, 2) all of the trip points are set over the preprogrammed distance measurements and 3) the direction variable is set to the reverse direction 106, the control module 60 detects the OFF condition 108 and deactivates the RFID reader. If the direction variable is not set to the reverse direction or all of the trip points are not set, the control module 60 awaits to receive a new current distance measurement from the proximity sensor.

If the current distance value exceeds the noise threshold value 100, the control module 60 increments a value of a noise counter variable 102 and compares the value of the noise counter variable to a second noise threshold value 104, the second noise threshold value being an integer value representing a predetermined number of occasions noise readings have been encountered. If the value of the noise counter variable meets or exceeds the second noise threshold value, the control module 66 directs the flag module 62 to reset the direction variable to non-movement of the mobile structure and the trip set module 64 to clear all previous trip points set 110. The control module then awaits to receive a new current distance measurement from the proximity sensor.

If an ON condition is to be detected 82, the control module 60 determines if the current distance value is less than a length of the support structure 112 of the mobile structure. If the current distance measurement is less than the length of the support structure, the control module 60 then compares the current distance value observed with a distance value observed at a prior time period 114. If the current distance measurement is less than the prior distance measurement, the control module 60 increments a value of a forward counter 116 which represents movement of the mobile structure in a forward direction. The control module 60 then compares the value of the forward counter variable to a forward threshold value 118 representing a number of occasions a forward movement has been detected, and directs the flag module 62 to set a direction variable to indicate the FORWARD direction of the mobile structure 120 if the value of the forward counter variable meets or exceeds the forward threshold value.

Next, the control module 60 compares the current distance measurement to a number of preprogrammed distance measurements. If the current distance measurement is less than the maximum preprogrammed distance measurements 122, the control module 60 determines whether a previous trip point value is set or alternatively, whether a first trip point value is to be set 124. If the previous trip point value is set or the first trip point value is to be set, the control module 60 directs the trip set module 64 to set a point value to represent movement of the mobile structure over a preprogrammed distance 126.

Next, the control module 60 determines whether the current distance value exceeds the noise threshold value 128. If 1) the current distance value does not exceed the noise threshold value, 2) all of the trip points are set over the preprogrammed distance measurements and 3) the direction variable is set to the forward direction 106, the control module 60 detects the ON condition 132 and activates the RFID reader. If the direction variable is not set to the forward direction or all of the trip points are not set, the control module 60 awaits to receive a new current distance measurement from the proximity sensor.

If the current distance value exceeds the noise threshold value 128, the control module 60 increments the value of the noise counter variable 102 and compares the value of the noise counter variable to the second noise threshold value 104, as discussed previously. If the value of the noise counter variable meets or exceeds the second noise threshold value, the control module directs the flag module 62 to clear the direction variable and all previous set trip points 110. The control module then waits to receive a new current distance measurement from the proximity sensor.

Various features of the system may be implemented in hardware, software, or a combination of hardware and software. For example, some features of the system may be implemented in computer programs executing on programmable computers. Each program may be implemented in a high level procedural or object-oriented programming language to communicate with a computer system or other machine. Furthermore, each such computer program may be stored on a storage medium such as read-only-memory (ROM) readable by a general or special purpose programmable computer or processor, for configuring and operating the computer to perform the functions described above.

What is claimed is:

1. A method for determining whether an object is positioned on or off a support structure of a mobile structure, the method comprising:

comparing a current distance value to a prior distance value and a N number of pre-programmed distance measurements, said prior distance value is a distance measurement from the mobile structure to the object at a first time period, said current distance value a distant measurement from the mobile structure to the object at a second time period, said second time period subsequent to said first time period, N being an integer value greater than 1;

setting a value of a direction variable to represent a movement of the mobile structure in a forward or reverse direction based on the comparison of the current distance value to the prior distance value;

setting a plurality of trip point values to represent movement of the mobile structure over the N number of preprogrammed distance measurements based on the comparison of the current distance value with the N number of pre-programmed distance measurements;

determining an on-off condition for the object based on the direction variable and the plurality of trip point values set.

2. The method of claim 1, comprising:

comparing the current distance value to a first noise threshold value, the first noise threshold value being a distance measurement; and determining the on-off condition based on the direction variable, the plurality of set trip points, and the comparison of the current distance value to the first nose threshold value.

3. The method of claim 2, comprising incrementing a value of a noise counter variable if the current distance value exceeds said first nose threshold value.

4. The method of claim 3, comprising:

comparing the value of the noise counter variable to a second noise threshold value, the second noise threshold value being a numeric integer value; and setting the plurality of trip point values and the direction variable to indicate non-movement of the mobile structure based on the comparison of the value of the noise counter variable to the second noise threshold value.

5. The method of claim 4, comprising setting the on-off condition to an OFF value if the value of the direction variable represents the reverse direction and the plurality of trip point values indicate the movement of the mobile structure, the OFF value representing the object positioned off the support structure.

6. The method of claim 5, comprising:

incrementing a value of a reverse counter variable if the current distance value exceeds the prior distance value;

comparing the value of the reverse counter variable to a reverse threshold value, the reverse threshold value being a numeric count value; and setting the direction variable to indicate the REVERSE direction of the mobile structure based on the comparison of the value of the reverse counter variable to the reverse threshold value.

7. The method of claim 6, comprising comparing the current distance value to the prior distance value if the current distance value exceeds a pre-determined minimum distance to detect an OFF condition of the mobile structure.

8. The method of claim 4, comprising setting the on-off condition to an ON value if the value of the direction variable represents the forward direction and the plurality of trip point values indicate the movement of the mobile structure, the ON value representing the object positioned on the support structure.

9. The method of claim 5, comprising:

incrementing a value of a forward counter variable if the current distance value is less than the prior distance value;

comparing the value of the forward counter variable to a forward threshold value, the forward threshold value being a numeric count value; and setting the direction variable to indicate the FORWARD direction of the mobile structure based on the comparison of the value of the forward counter variable to the forward threshold value.

10. The method of claim 6, comprising comparing the current distance value to the prior distance value if the current distance value is less than a length of the support structure.

11. The method of claim 1, comprising coupling operatively a proximity sensor to the mobile structure to determine the current distance and prior distance values.

12. The method of claim 1, comprising at least one of activating and deactivating an RFID reader to communicate with an RFID tag associated with the object based on the on-off condition.

13. A RFID reader operatively coupled to a mobile structure, the RFID reader configured to determine whether an object associated with an RFID tag is positioned on or off a support structure of the mobile structure, the RFID reader including a processor and memory configured to include memory storing instructions that, in response to a request, cause the processor to:

compare a current distance value to a prior distance value and a N number of pre-programmed distance measurements, said prior distance value is a distance measurement from the mobile structure to the object at a first time period, said current distance value a distant measurement from the mobile structure to the object at a second time period, said second time period subsequent to said first time period, N being an integer value greater than 1;

set a value of a direction variable to represent a movement of the mobile structure in a forward or reverse direction based on the comparison of the current distance value to the prior distance value;

set a plurality of trip point values to represent movement of the mobile structure over the N number of pre-programmed distance measurements based on the comparison of the current distance value with the N number of pre-programmed distance measurements; and determine an on-off condition for the object based on the direction variable and the plurality of trip point values set.

14. The RFID reader of claim 13, wherein the memory stores instructions that, in response to receiving the request, cause the processor to:

compare the current distance value to a first noise threshold value, the first noise threshold value being a distance measurement; and determine the on-off condition based on the direction variable, the plurality of set trip points, and the comparison of the current distance value to the first nose threshold value.

15. The RFID reader of claim 14, wherein the memory stores instructions that, in response to receiving the request, cause the processor to increment a value of a noise counter variable if the current distance value exceeds said first nose threshold value.

16. The RFID reader of claim 15, wherein the memory stores instructions that, in response to receiving the request, cause the processor to:

compare the value of the noise counter variable to a second noise threshold value, the second noise threshold value being a numeric integer value; and set the plurality of trip point values and the direction variable to indicate non-movement of the mobile structure based on the comparison of the value of the noise counter variable to the second noise threshold value.

17. The RFID reader of claim 16, wherein the memory stores instructions that, in response to receiving the request, cause the processor to set the on-off condition to an OFF value if the value of the direction variable represents the reverse direction and the plurality of trip point values indicate the movement of the mobile structure, the OFF value representing the object positioned off the support structure.

18. The RFID reader of claim 17, wherein the memory stores instructions that, in response to receiving the request, cause the processor to:

increment a value of a reverse counter variable if the current distance value exceeds the prior distance value;

compare the value of the reverse counter variable to a reverse threshold value, the reverse threshold value being a numeric count value; and set the direction variable to indicate the REVERSE direction of the mobile structure based on the comparison of the value of the reverse counter variable to the reverse threshold value.

19. The RFID reader of claim 18, wherein the memory stores instructions that, in response to receiving the request, cause the processor to compare the current distance value to the prior distance value if the current distance value exceeds a length of the support structure.

20. The RFID reader of claim 16, wherein the memory stores instructions that, in response to receiving the request, cause the processor to set the on-off condition to an ON value if the value of the direction variable represents the forward direction and the plurality of trip point values indicate the movement of the mobile structure, the ON value representing the object positioned on the support structure.

21. The RFID reader of claim 17, wherein the memory stores instructions that, in response to receiving the request, cause the processor to comprising:

increment a value of a forward counter variable if the current distance value is less than the prior distance value;

compare the value of the forward counter variable to a forward threshold value, the forward threshold value being a numeric count value; and set the direction variable to indicate the FORWARD direction of the mobile structure based on the comparison of the value of the forward counter variable to the forward threshold value.

22. The RFID reader of claim 18, wherein the memory stores instructions that, in response to receiving the request, cause the processor to compare the current distance value to the prior distance value if the current distance value is less than a length of the support structure.

23. The RFID reader of claim 13, wherein a proximity sensor is at least one of operatively coupled to the RFID reader and included in the RFID reader for determining the current distance and prior distance values.

24. The RFID reader of claim 13, wherein the RFID reader is at least one of activated and deactivated to communicate with the RFID tag based on the on-off condition.

25. The RFID reader of claim 13, wherein the mobile structure is at least one of a forklift, pallet jack, hand truck, and conveyor.

* * * * *

UNITED STATES PATENT AND TRADEMARK OFFICE

CERTIFICATE OF CORRECTION

PATENT NO. : 8,188,863 B2
APPLICATION NO. : 12/323656
DATED : May 29, 2012
INVENTOR(S) : Rinkes et al.

It is certified that error appears in the above-identified patent and that said Letters Patent is hereby corrected as shown below:

In Column 10, Line 12, in Claim 2, delete “nose” and insert -- noise --, therefor.

In Column 10, Line 16, in Claim 3, delete “nose” and insert -- noise --, therefor.

In Column 11, Line 41, in Claim 14, delete “nose” and insert -- noise --, therefor.

In Column 11, Line 46, in Claim 15, delete “nose” and insert -- noise --, therefor.

In Column 12, Line 32, in Claim 21, after “processor” delete “to”.

Signed and Sealed this
Fifteenth Day of January, 2013

David J. Kappos

David J. Kappos
*Director of the United States Patent and Trademark Office*